United States Patent [19]

Weber

[11] Patent Number: 4,622,899

[45] Date of Patent: Nov. 18, 1986

[54] SMOKE PROJECTILE WITH SEQUENTIAL CHARGES AND CENTRAL IGNITOR

[75] Inventor: Manfred Weber, Eisenberg, Fed. Rep. of Germany

[73] Assignee: Pyrotechnische Fabrik F. Feistel GmbH & Co. KG, Fed. Rep. of Germany

[21] Appl. No.: 543,112

[22] Filed: Oct. 14, 1983

[30] Foreign Application Priority Data

Oct. 16, 1982 [DE] Fed. Rep. of Germany ..... 32384556

[51] Int. Cl.[4] ..... F42B 13/34

[52] U.S. Cl. ..... 102/334; 102/345; 102/360

[58] Field of Search ..... 102/334, 345, 360

[56] References Cited

U.S. PATENT DOCUMENTS

| | | | |
|---|---|---|---|
| 2,502,442 | 4/1950 | Driskell | 102/334 |
| 3,542,610 | 11/1970 | Lane et al. | 102/334 X |
| 3,881,420 | 5/1975 | Smith et al. | 102/334 |
| 3,884,734 | 5/1975 | Palmer et al. | 102/334 X |
| 4,210,555 | 7/1980 | Lübbers et al. | 102/334 X |
| 4,406,815 | 9/1983 | Magnusson et al. | 102/334 X |
| 4,484,195 | 11/1984 | Shaffer | 102/334 X |

*Primary Examiner*—Peter A. Nelson

*Attorney, Agent, or Firm*—Berman, Aisenberg & Platt

[57] ABSTRACT

Several pyrotechnic smoke screen sets are arranged on top of each other. Each of them has an igniter and a decomposition sets. They are in separate containers which, in succession, are ignited by a delay device at a desired interval.

25 Claims, 10 Drawing Figures

FIG. 2a
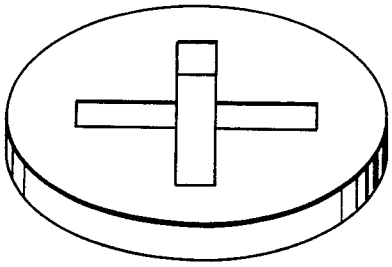
FIG. 2b
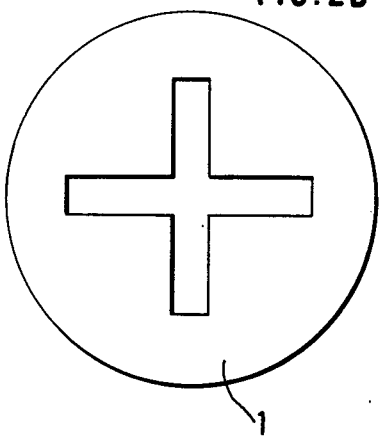
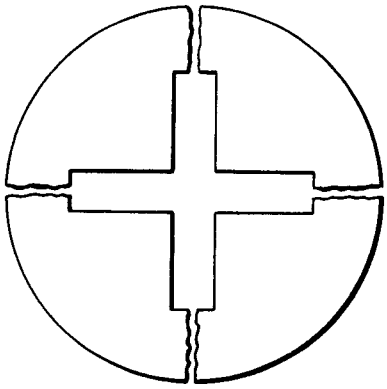
FIG. 2c
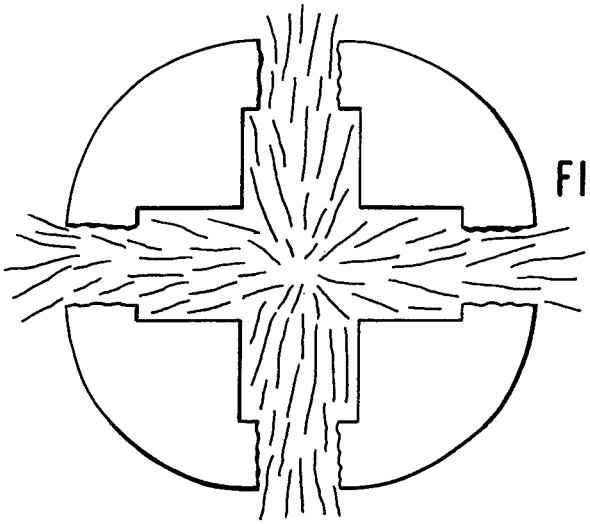
FIG. 2d

SMOKE PROJECTILE WITH SEQUENTIAL CHARGES AND CENTRAL IGNITOR

RELATED APPLICATION

The subject matter of this application is related to that of the inventor's U.S. application Ser. No. 534,944, filed on Sept. 21, 1983, the entire disclosure of which is incorporated herein by reference.

BACKGROUND

"Berichte des Instituts fur Chemie der Treib-und Explosionsstoffe der Fraunhofer Gesellschaft, Jahrestagung 1975" [Reports of the Institute of Chemistry of Propellent Substances and Explosives of the Fraunhofer Society, 1975 Annual Congress], Karlsruhe, 1975, pages 185–194, reveals that IR radiation of certain wavelengths is selectively absorbed by atmospheric components as a result of which so-called "atmospheric windows" develop. These windows are found at wavelengths of 0.7–1.5$\mu$ and all the way to 8–12$\mu$. This knowledge and application of Rayleigh's law led to the use of various forms of powder as smoke for camouflage purposes (cf. German Patent Application Published for Opposition DE-AS No. 27 29 055).

These powders, however, produce only unsatisfactory optical concealment and have a relatively high settling rate.

SUMMARY OF INVENTION

The invention involves a mechanism which makes it possible to generate both an optically-concealing and also an IR-absorbing smoke screen, whereby the IR-absorbing component provides a longer-lasting effect. This is done with the help of a smoke projectile which consists of a can with an ignition device as well as a smoke set and an igniter set having a decomposing effect, which is characterized by the fact that two different smoke sets are arranged one above the other, whereby one of them, in an exothermal reaction, creates an optical smoke screen and the other one is a powder with IR-absorbing properties, the igniter set or the decomposition set being arranged in the middle between both smoke screen sets.

The effect of this mechanism is probably as follows:

During its trajectory (or while lying on the ground) the smoke projectile ignites the igniter set, which has a decomposing effect for the optically-acting smoke screen set. The latter is broken down into many small particles which fall down on the ground and which (in the process) generate smoke and heat. A large number of regions of ascending currents arise in this process.

Immediately after the ignition of the optical smoke set, however, the decomposition set for the powder is also ignited, and it distributes the powder within the optical smoke. Due to the action of the large number of thermal fields, it is now possible to keep the smoke powder in suspension considerably longer than would be the case without the addition of optical smoke. Suspension and charge separation effects may possibly also play a role here.

BRIEF DESCRIPTION OF THE DRAWINGS

FIGS. 2*a–d* shows the pressed bodies for the optical smoke set.

FIGS. 4*a–d* shows a combination of several pyrotechnic smoke sets.

DETAILS

Figure 1:
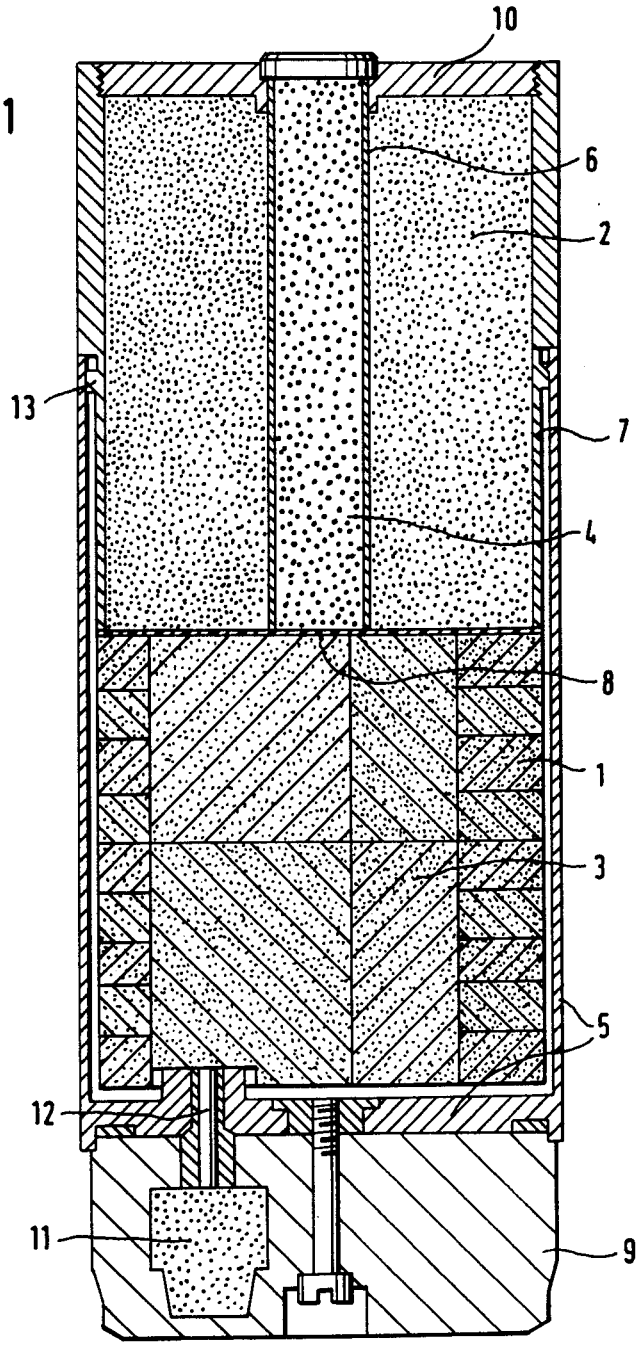
FIG. 1 shows the structure of the projectile.

A combination, where the IR set is a metal powder and the optical smoke mixture consists of pressed objects which are layered on top of each other and which are provided with slits, has proved particularly effective, whereby the slits form a channel for the reception of the igniter set. These pressed bodies also burn off in a delayed fashion and not spontaneously in the decomposed state as relatively large particles so that, first of all, a constant supply of optical smoke is produced and, besides, separate thermal fields are supported in which the settling powder particles are kept in suspension or can even be moved upward.

The invention provides for housing the smoke set—in other words, the powder—in a separate container in the can, separated from the optical smoke set. This container has a pipe stud in the middle for the reception of the decomposition sets.

This simple solution makes it possible to adapt the decomposition sets or the igniter sets to the smoke components, that is to say, to match the optimum set up with each smoke. Provision has been made here for locking the bottom of the stud with a foil 8 and that makes assembly easier and prevents chemical reactions between them.

Particularly good results are achieved when a lamellar powder, preferably copper powder, is used as powder. This powder is available on the market and has a specific surface of from 3,200 to 16,000 $cm^2/g$ with particle diameters of from 1.9 to 0.45$\mu$. The lamellar structure of the particles has a particularly favorable effect in combination with the exothermal processes according to available investigations.

To prevent the powder from being baked together during the process of filling the container and during storage and to prevent it from then no longer being capable of being satisfactorily suspended, it is proposed to add to it a separation agent, such as ammonium phosphate, Teflon or highly-dispersed silicic acid, alone or in combination.

Another objective of the invention at hand is to increase the effectiveness of produced smoke screen walls.

For example, if such a smoke is generated during a wind, then it is often too quickly removed from the targets to be protected. It is basically possible, in succession, to fire several projectiles with different ranges in order thus to extend the smoke screen wall in a horizontal direction.

This method is inaccurate and excessively large gaps develop between the individual smoke screen fields.

It is therefore proposed to arrange several pyrotechnic smoke screen sets on top of each other. Each of them here has an igniter set and a decomposition set. These units are separated from each other by a separation disc. They are in separate containers which, in succession, are ignited by a delay device (arranged in the separation disc) at the desired interval.

The separate containers can contain differing quantities of smoke sets, in particular, several pyrotechnic sets can be combined with several metal powder sets.

It is furthermore possible to fire the sets with the help of a rocket. The engine ignites the first set in flight. The first set is blown off and distributes the smoke screen set in the manner of an explosion with good spherical characteristics all around.

After the delay device of the next following set has burned off, that set is ignited; this sequence is repeated sequentially all the way to the foremost set. In this way a chain of smoke units, which flow together to form a long wall, is produced.

Finally, it is possible to arrange the powder sets in the individual pyrotechnic sets so that they can be applied without delay or with relatively short delay so as to be brought into the pyrotechnic smoke screen cover.

As the decomposition set for the powder a known set, e.g., one consisting of about 60% perchlorate and 40% metal powder, such as aluminum or magnesium, can be used.

An optical smoke set which is particularly effective consists of a pressed body made of chlordonator, metal oxide, and ammonium chloride as well as:

5–40% by weight of thiourea,

20–70% by weight of ammonium perchlorate,

1–3% by weight of aluminium powder with a grain size of 100μ and

5–30% by weight of binder,

Or which is built up on the basis of red phosphorus.

This smoke set is described in German Patent Application Laid Open to Inspection DE-OS No. 30 31 369, just like the ignition or decomposition mixture which is to be used here preferably and which was proposed in this connection.

The smoke set, however, can also be built up in the known manner on the basis of red phosphorus (see above), which can likewise be made into pressed bodies with the help of suitable binders.

Preferably, we use pressed bodies which were pressed at pressures of 500–1,500 bar. These bodies reveal a sufficiently small surface after decomposition, in other words, they are big enough so that they will not burn off too fast.

The invention at hand is particularly suitable for so-called close-in protection.

It is also quite readily possible to superpose a third action direction upon both smoke components, that is to say, further to boost the effect, which is already present against radar acquisition, due to the use of metal powder or to bring such an effect about due to the use of other powders. Here it is proposed (according to the invention) that we admix with the powder set a glass fiber material which is in itself known and which has fiber lengths of from about 2 to 30 mm, so-called chaff.

The following example represents one of the possible combinations. As powder component we merely selected lamellar copper with a surface, according to Fisher, between 3,200 and 16,000 $cm^2/g$. It corresponds to powder particle diameters of 1.9–0.4μ. About 0.5% by weight of highly dispersed silicic acid was admixed with the copper powder. The decomposition set for this IR smoke consisted of 60% ammonium perchlorate and 40% by weight magnesium and aluminum powder mixture.

The optical smoke set was made in the following manner:

The preparation of 2.2 kg of PVC powder, 3.3 kg of zinc oxide (dried), 2.2 kg of ammonium chloride, and 2.64 kg of thiourea is pressed through a sieve with a mesh width of from 0.3 to 0.5 mm and is then mixed intensively. After that, the preparation is placed in a kneading machine and is made into a dough with 2.4 kg (related to the test body) of a highly viscous elastomer binder for a period of 15 minutes. After completion of the kneading process, we add 7.26 kg of ammonium perchlorate, processed according to the same screening method. This preparation is kneaded for another 15 minutes and is then spread out on a screen and is afterward dried for 6 hours at a temperature of 45° C. Then the dry mass obtained is comminuted in a friction chopping machine and is finally pressed into pressed bodies at a pressure of about 100 bar.

These pressed bodies are round and, in the middle, they have a cross-shaped slit for the reception of the decomposition-ignition set. These discs were layered above each other and were arranged in the slits of the decomposition-ignition set and were housed in the can. This set was made in the following manner:

In a mixing container, we thoroughly mix 1.2 kg of magnesium powder and 0.9 kg of vivianite. To this mixture we add 0.8 kg of (powdery) paraffin chloride which has been dissolved in 2 liters of perchloroethylene. This solution is thoroughly mixed with the previous mixture in a mixer for 10 minutes. Then we add 2.39 kg of amorphous boron and we repeat the mixing process for 5 minutes. As the last set component we add 4.71 kg of black powder meal (on a two-component basis, that is to say, without the addition of sulfur) into the mixing vessel and we mix once again for 10 minutes. After that, the set, which is moistened with solvent, is shaken through a 1.5 mm sieve and is spread out on a drying screen. After a drying time of 5 hours at +45° C., the set can be pressed into rods at a pressing pressure of 1,500 bar.

This decomposition-ignition set is excellently suitable for a specifically oriented and controlled decomposition of the pressed bodies.

The metal powder was filled into the container and the pertinent decomposition set was filled into the container's tube which was arranged in the middle. The container was housed in the can above the optical smoke charge and the can was closed with a lid. The ignition head was screwed under the can and the pyrotechnic charge was ignited.

We obtained an optical smoke of outstanding quality with very clearly pronounced IR effect. Quite surprisingly, this IR effect continued to exist considerably longer than when the powder alone was applied. When the powder alone was applied, we get action times that are a function of the weather conditions and that extend between about 15 and 30 seconds, whereas, on the other hand, optical smoke can be effective for 2 minutes and longer.

In the combination according to the invention, IR effectiveness of definitely more than 30 seconds was observed.

The invention at hand will now be explained in greater detail with the attached figures.

The projectile consists of can 5 with ignition head 9 and lid 10. The ignition head contains a powder chamber 11 as well as a delayed set 12.

In the can, associated with the ignition head 9, we first of all have the optical smoke set 1 which consists of superposed slotted tablets [slotted tablets layered on top of each other]. The slits in the tablets are aligned toward each other so that we get a crossed channel for the reception of the ignition-composition set 3. Over this smoke set, container 7 is pushed into can 5 and is locked with the help of a bayonet lock 13.

Container 7 is a cylindrical body with a tube 6 arranged in the middle which, on the side toward the bottom, is closed with the help of a foil.

Container 7 contains powder 2; the decomposition unit 4 is housed in the tube. Can 5 and, simultaneously, container 7 are closed off by lid 10.

This structure results in production engineering advantages. But it is also possible to associate the powder container 7 with the ignition head 9 and to layer the smoke tablets 1 on top. Because the ignition process takes place extremely fast, this does not create any essential differences here.

FIG. 2 shows the slotted smoke tablets to be used. At the end of the slits, the structure of the bodies is weakened. As illustrated in *2c* and *2d*, the structure here is torn particularly easily. As a result of the decomposition unit's explosion, more compact particles can thus be flung away and, during burn-off, they form the individual stationary ascending wind sources for the powder suspended therein. Because of the intervals between the smoke sources, we have sufficient temperature difference between the surrounding air and the quasi-adiabatically rising smoke "columns." In other words, a very uneven temperature profile prevails in the smoke. Customary smoke screens, which originate due to the burn-off or expulsion from a single source, on the other hand, have a more uniform temperature profile in which no thermal action can develop because of absent potentials. This smoke acts as a whole like an adiabatic bubble.

Figure 3:
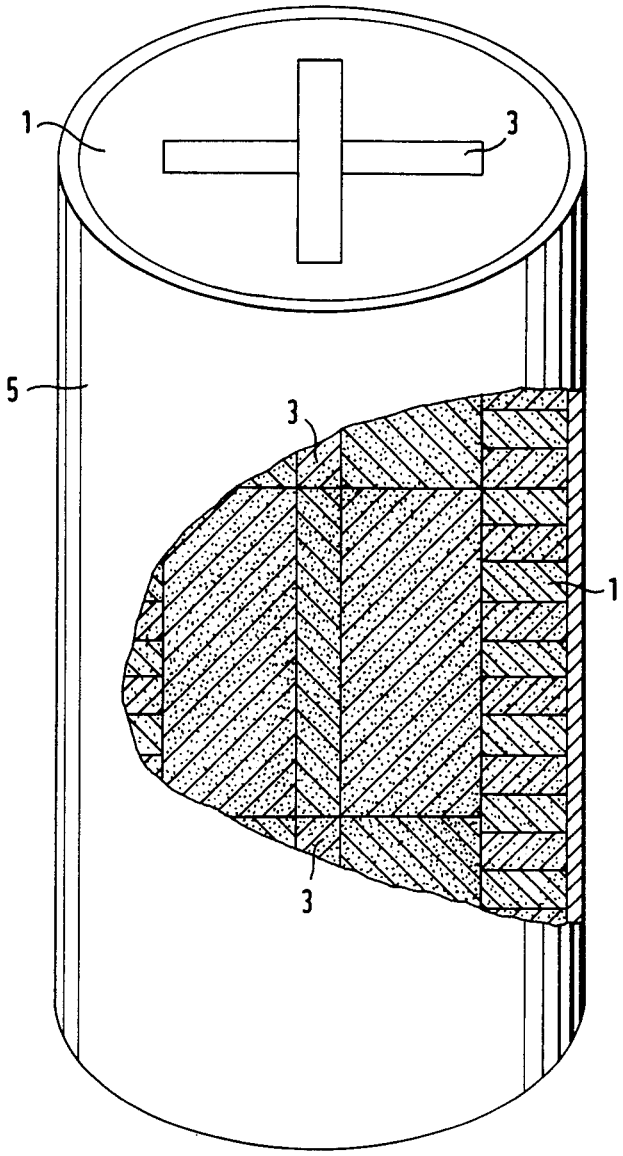
FIG. 3 shows the structure of the optical set in the can.

FIG. 3 in greater details shows the structure of the optical smoke set with can 5, superposed tablets 1 and ignition-decomposition particles 3 which are pushed into the slits of the tablet. The edge of can 5 naturally is higher than illustrated here and receives the powder container.

Figure 4A:
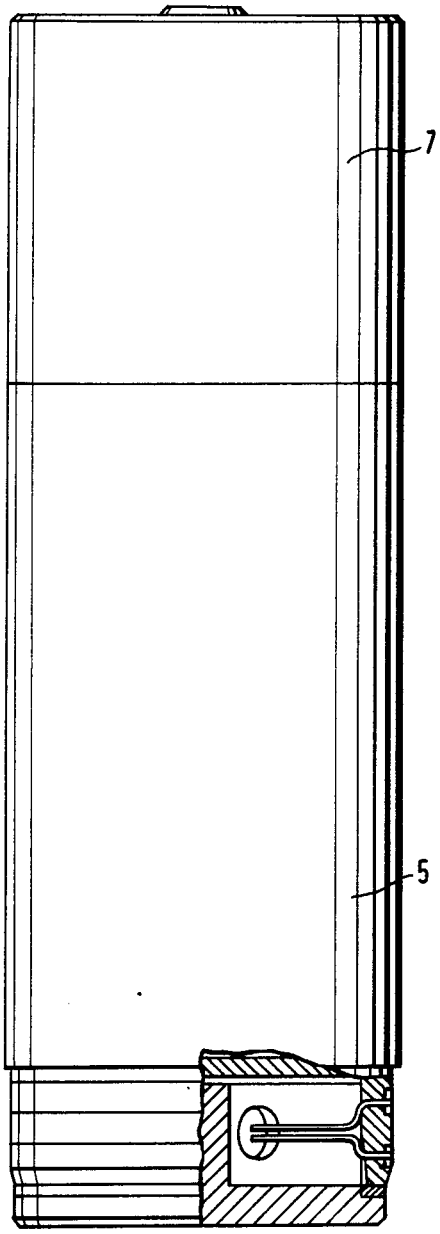
Figure 4B:
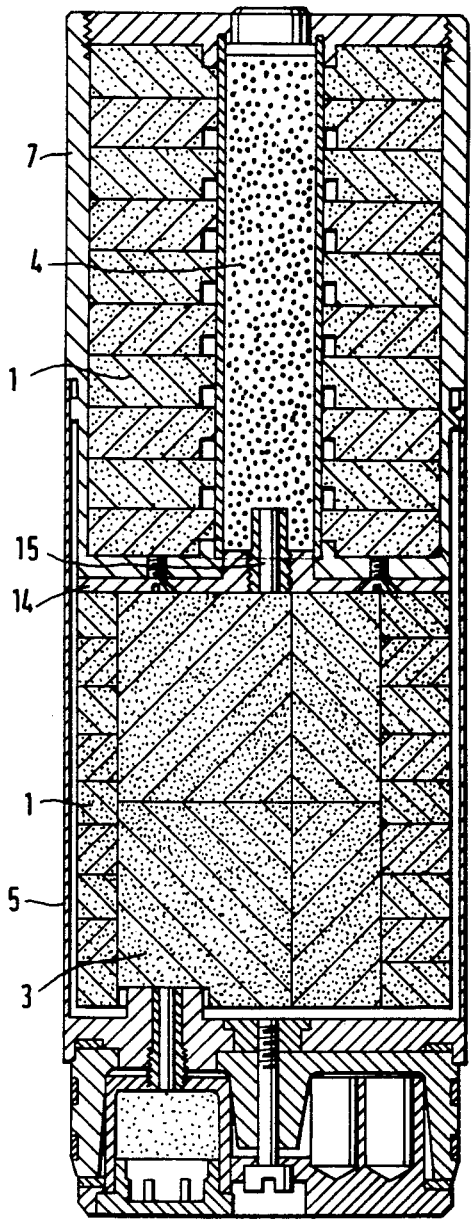

FIG. 4 illustrates the combination of a multiple charge with pyrotechnic smoke.

The first set is contained in can 5. Above it and connected with it, in the separate container 7, we find the second set. Can 5 and container 7 are separated from each other by the separation disc 14 in a manner protected against explosion so that the decomposition of the set contained in can 5 will not influence the one [set] above it.

Delay device 15 is arranged in separation disc 14.

It works in the following manner:

Due to the ignition of the set in can 5, this set is broken down and the delay unit 15 starts burning. Protected by separation disc 14, the set, arranged in container 7, continues to fly on and is decomposed elsewhere after the delay unit 15 has burned off. Due to the spherical characteristic of smoke expulsion, the boundary lines of the smoke flow into each other. We thus get a wall corresponding to the number of expelled individual charges.

The combination illustrated in FIG. 4 shows two charges. It is of course possible to combine three and more separate projectiles with each other, whereby one can also intersperse metal powder sets.

Figure 5A:
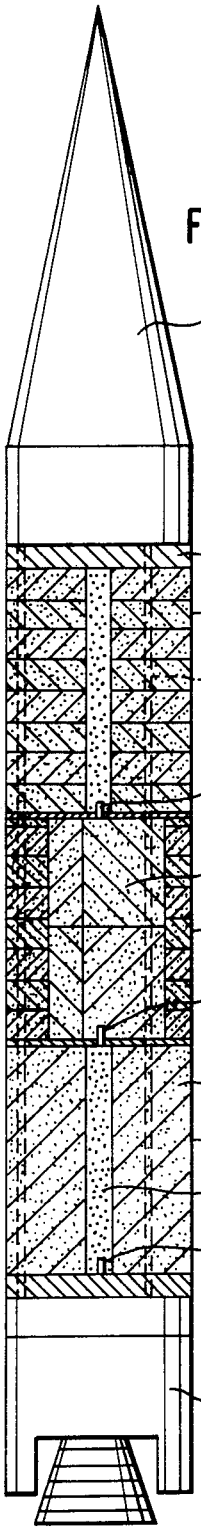
FIG. 5*a* shows an arrangement of the sets in a rocket.
Figure 5B:
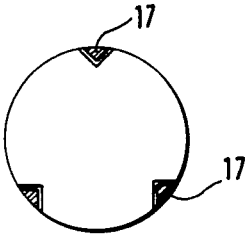
FIG. 5*b* is a cross-section of the arrangement of FIG. 5*a*.

FIG. 5 shows the arrangement according to the invention in a rocket. It consists of engine 16, rocket warhead 19, and a supporting structure illustrated here in the form of three struts 17.

By way of example, one metal powder set and two separate pyrotechnic smoke sets are illustrated here. Struts 17 can be embedded in the container walls, as we can tell from the profile drawing. They are positioned in discs 20 and the anchor head 19 with engine 16.

The number of sets is not limited to the three illustrated here; instead, further sets can be added, as needed. It is particularly advantageous to install the above-mentioned metal powder sets between them.

It works as follows.

The rocket engine powers the rocket in the direction of flight. After a predetermined time interval, the engine ignites the first set which is decomposed. Because of struts 17, the other sets remain in their positions and are ignited in each case one after the other, following the burn-off of their delay devices.

The rocket engine can be so designed here that it will provide power up to the ignition of the last smoke set 18.

What is claimed is:

1. A smoke-screen-generating projectile having imperforate side walls, a central axis and an ignition device and wherein:

two or more smoke charges or sets of smoke charges are sequentially arranged along the central axis, each smoke charge or set of smoke charges is in a separate chamber, adjacent smoke charges or sets of smoke charges have a corresponding ignition charge with decomposition action along said central axis, the ignition device is adjacent one of plural sequential smoke charges or sets of smoke charges; and the decomposition action is sufficient to breakdown smoke charges into pieces and to disperse the pieces so that they are separated from each other, each such piece thereafter comprising independent means for generating smoke.

2. A projectile according to claim 1 wherein:

each chamber is in a container, containers for adjacent smoke charges or sets of smoke charges are connected with each other, the smoke charge or set of smoke charges immediately adjacent the ignition device is one which has a capacity to generate an optical and/or an IR-absorbing smoke in an exothermal reaction, each other smoke charge or set of smoke charges independently comprises either powder with IR-absorbing properties or a pyrotechnic smoke charge, each pyrotechnic smoke charge is one of a series of adjacent pressed-body-form units having an aperture therethrough and disposed so that the aperture in each unit, which is substantially the same size and shape as that in adjacent units, is lined up with those of adjacent units to form a channel suitable for deposition of the ignition charge with decomposition action, each chamber is separated from each adjacent chamber by a separation disc having a centrally disposed delay device.

3. A projectile according to claim 1 which has one ignition set or charge associated with a smoke charge or set of smoke charges in one chamber and a different ignition set or charge associated with a smoke charge or set of smoke charges in an adjacent chamber.

4. A projectile according to claim 3 having an ignition charge with decomposition action within a tube in the one chamber, the tube being closed off between the two chambers by foil.

5. A projectile according to claim 1 wherein at least one smoke charge or set of smoke charges has a capacity to generate an optical smoke and comprises a pressed body of (a)
chlordonator
metal oxide
ammonium chloride
5 to 40% thiourea
20 to 70% ammonium perchlorate
1 to 3% aluminum powder with a grain size of not more than 100 microns and
5 to 30% binder,
all percentages being by weight, or (b) a composition based on red phosphorus.

6. A projectile according to claim 1 wherein at least one smoke charge or set of smoke charges has a capacity to generate optical smoke, the corresponding ignition charge being a decomposing mixture of magnesium powder, black powder meal, oxygen donor, binder, catalyst, an iron (II) iron (III) complex and, optionally, amorphous boron wherein the magnesium powder has a particle size of at most 100 microns.

7. A projectile according to claim 1 wherein each chamber is in a container, and adjacent containers are secured together by a bayonet lock.

8. A projectile according to claim 1 wherein the ignition device is a rocket engine, each chamber is in a separate container, and the several containers are held together by a strut construction by which the rocket engine is connected to the ignition charge for the smoke charge or set of smoke charges most remote from said rocket engine.

9. A smoke projectile according to claim 8 which also has a rocket warhead and wherein the strut construction comprises supporting struts which surround the containers and connect the rocket engine to the rocket warhead.

10. A projectile according to claim 1 wherein powder with IR-absorbing properties and an ignition charge with decomposition action are in one chamber, the ignition charge being in a separate tube within the one chamber.

11. A projectile according to claim 10 wherein the powder is copper powder.

12. A projectile according to claim 11 wherein the powder is lamellar copper powder with a surface area of from 3,200 to 16,000 $cm^2/g$ and with particles having diameters of from 1.9 to 0.45$\mu$.

13. A projectile according to claim 10 wherein the powder comprises a separation agent selected from the group consisting of ammonium phosphate, Teflon and highly-dispersed silicic acid.

14. A projectile according to claim 10 wherein the ignition charge in the one chamber with the powder comprises a mixture of about 60 percent by weight perchlorate and about 40 percent by weight of metal powder.

15. A projectile according to claim 14 wherein the metal of the metal powder in said ignition charge is a member selected from the group consisting of aluminum and magnesium.

16. A projectile according to claim 10 wherein the powder comprises a component which acts in the radar range.

17. A projectile according to claim 16 wherein the component comprises glass fibers having lengths of from 2 to 30 mm.

18. A projectile according to claim 1 comprising means for suspending a metal powder in optical smoke produced by an exothermal reaction.

19. A projectile according to claim 1 comprising means for generating smoke which simultaneously conceals both optically and in the IR range.

20. A projectile according to claim 19 comprising means for suspending a metal powder in optical smoke produced by an exothermal reaction.

21. A projectile according to claim 20 wherein the metal powder is a lamellar metal powder.

22. A projectile according to claim 20 comprising means for burning off a pressed smoke charge or a set of pressed smoke charges to produce optical smoke.

23. A projectile according to claim 1 wherein the ignition charge decomposition action comprises means for distributing particles of each smoke charge.

24. A projectile according to claim 23 comprising means for burning off distributed particles to generate smoke over a wide area and to produce an effective smoke screen.

25. A projectile according to claim 1 comprising means for generating an IR-absorbing smokescreen suitable for camouflage.

* * * * *